US008261780B2

(12) United States Patent
Thomas et al.

(10) Patent No.: US 8,261,780 B2
(45) Date of Patent: Sep. 11, 2012

(54) RFID CONTROLLED CHEMICAL PORPORTIONER AND DISPENSER

(75) Inventors: Gordon Thomas, Mason, OH (US); Joseph Morin, West Chester, OH (US); Brian D Rau, Cincinnati, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 985 days.

(21) Appl. No.: 12/184,412

(22) Filed: Aug. 1, 2008

(65) Prior Publication Data

US 2010/0024915 A1 Feb. 4, 2010

(51) Int. Cl.
*B65B 1/04* (2006.01)

(52) U.S. Cl. ..... 141/9; 141/94; 141/104; 141/105

(58) Field of Classification Search ..... 141/9, 94, 141/100, 104, 105, 107, 311 R, 351, 360
See application file for complete search history.

(56) References Cited

U.S. PATENT DOCUMENTS 4,227,818 A * 10/1980 Gacki et al. ..... 366/142
5,603,430 A * 2/1997 Loehrke et al. ..... 222/1
6,883,560 B2 * 4/2005 Beldham et al. ..... 141/18
6,968,876 B2 * 11/2005 Yacko et al. ..... 141/361
2011/0011888 A2 * 1/2011 Beavis et al. ..... 222/52

* cited by examiner

*Primary Examiner* — Gregory Huson
*Assistant Examiner* — Jason K Niesz
(74) *Attorney, Agent, or Firm* — Wood, Herron & Evans, LLP

(57) ABSTRACT

A chemical dispenser reads RFID tags on both chemical source and diluted chemical mixture containers. A dispensing button shifts and electric controller from low to high power state for such reading and initiation of dispensing when data read from such tags is determined compatible. A battery powers the controllers in both power states. A selector valve for selecting a chemical concentrate at one of several source stations also provides selected station information to the controller. A controller learn mode stores data from RFID tags on the concentrated chemical containers, with the controllers initiated in a high power state in response to entering the learn mode. An alternate embodiment substitutes an alternative receiving container such as a mop bucket, and a dispensing nozzle is provided with an RFID reader for reading an RFID tag on the alternative container. Methods are provided.

21 Claims, 6 Drawing Sheets

RFID CONTROLLED CHEMICAL PORPORTIONER AND DISPENSER

This invention relates to multiple chemical dilution and dispensing and more particularly to multiple chemical dilution and dispensing systems which insure the selected chemical is the actual chemical dispensed when the dispenser is activated.

In the past, it has been known to use RFID ("radio frequency identification") technology to identify chemicals and insure the identity of a chemical associated with a predetermined source. Specifically, it is known to supply a chemical concentrate in a container provided with an RFID tag having particular identification function for that specific chemical. Such a container may be introduced into a physical dock or apparatus having a plurality of chemical source stations. Each station is outfitted with an RFID antenna or reader for reading the RFID tag on the container. Once the programmed electronics are active and a container bearing the wrong chemical is introduced to a source station, the RFID system will-generate an error indicator and prevents dispensing that chemical from that station. Thus, only containers bearing a specific predetermined chemical concentrate can be dispensed from a station having an RFID reader which recognizes only that predetermined chemical-indicating RFID tag. In this way, an operator is prevented from dispensing the wrong chemical into a diluent and using that mix in a way which could cause damage or harm or insufficient cleaning. Errors occurring by loading the wrong chemical container into a source station or dispensing an undesired chemical from a particular station are eliminated.

As an example of prior RFID controlled systems, U.S. Pat. No. 6,968,876 discloses an RFID system used in such a multiple chemical dispenser. The patent system recognizes "source" and "receive" information through RFID technology to confirm that the correct receiving container will be used with the correct chemical source. This system prevents errors in dispensing a diluted chemical into a receiving bucket where another diluted chemical was desired. Thus, both the chemical source container and the diluted chemical receiving container have RFID tags specific to their current or intended contents. A control system prevents dispensing of a chemical, through a diluent, from or to a non-matching container.

Such a system as disclosed has several inherent disadvantages. For example, in the system as described, there does not appear to be any disclosure showing how the electronic circuit knows which chemical concentrate is selected for dispensing. In particular, the apparatus is set up so that each chemical station is programmed for one chemical. This limits the flexibility of the dispenser.

Perhaps a more important factor is the need for electric power for the RFID and control related circuitry. If not battery operated, the system must be connected to a hard-wired source of A.C. electricity. This constitutes a limitation for installation location and of cost.

Moreover, the use of battery power in such a system is not currently thought to be feasible. For example, where the electronic circuit constantly searches for an activation signal (even if only at a low rate of once per second), the constant electric drain would be so large as to either require a huge, expensive, heavy battery or would quickly discharge a smaller battery.

Accordingly, it is desired to provide an improved dispenser for insuring the proper chemical is dispensed into a proper receiving container, but with the flexibility of using multiple concentrated chemical source stations and multiple dilute receiving containers.

A further objective of the invention has been to provide a multiple chemical dispenser preventing dispensing of the wrong chemical but without need for an A.C. power source, and with extended operational cycle times relative to prior battery-powered units.

It is a further objective of the invention to provide a multiple chemical dispenser where a control is programmed at the dispenser to indicate and dispense the proper chemical for dispensing into the proper receiving container.

A yet further objective of the invention is to provide a multiple chemical dispenser with a long-lasting battery powered electronic control for insuring dispensing of a selected chemical over an improved battery cycle life.

A yet further objective of the invention is to provide an improved battery powered control apparatus for preventing dispensing of an undesired chemical and wherein the battery constantly supplies full operating power only upon initiation of a chemical dispensing cycle.

A yet further objective of the invention is to provide an improved multiple chemical dispensing system.

To these ends, the invention contemplates a battery-powered RFID control system for multiple chemical dispensing wherein the control system or circuit is fully energized, not constantly, but only upon activation of a dispensing button for a chemical to be dispensed and activation of the diluent flow.

The invention further contemplates a dispenser wherein information relative to a chemical placed at a source station is sensed and compared to a stored library of possible chemicals for that station. Once approved, a manual selector is moved to indicate and select a desired source station for dispensing. A receiving container at the receiving station is sensed and evaluated to confirm the container at the receiving station is compatible with the chemical concentrate selected for dispensing from the selected source station. Once cleared, the dispensing commences. In the interim, only an insignificant electrical draw for idling functions, such as LED lights or the like, is active, preserving battery life.

More specifically, one embodiment of the invention contemplates, in a chemical dispensing system, the substitution or addition of a latching solenoid for the typical button activated water (diluent) valve, or other apparatus for this function.

A chemical selector button is provided for selection of the chemical source to be dispensed. Once the chemical dispensing station is selected and the dispensing button pushed, a magnet in the dispensing button is moved toward the circuit board and a Hall effect sensor or other suitable switching or sensing device wakes up or activates the battery-powered board to a higher energy level.

Upon power activation the board confirms if the source and receive RFID tags associated with the respective selected docking stations for the concentrated chemical and diluted mix receiving containers match. If they do, the board operates the water valve solenoid to latch open the water valve and initiate dispensing. This allows the correct chemical (source) to be diluted and dispensed into the correct receiving container. The water valve solenoid relatches or is closed when the discharge button is released and magnet moves away from the board again. If there is no match of the concentrate's related RFID tag with the stored data library to insure dispensing a proper chemical for the type of treatment selected by the selector switch, or if the receiving container RFID tag at the receiving station does not match the library of approved receptors for that chemical dilution, the water solenoid, will not latch, the water valve remain closed and no chemical will be dispensed. In addition, an "Error" LED will be illuminated to let the end user know a match did not occur.

The invention contemplates placing a magnet or other component on the knob of the selector valve so the board (with additional Hall effect or other sensors) is signaled which chemical dispensing station is selected. When the dispensing button is activated and the circuit energized, the board will know which chemical the user has selected since there will be RFID tags located underneath each of the container holders in the cabinet.

By using the magnet and Hall effect sensor in connection with the dispensing or activate button, the circuitry does not require full operating power prior to activation and can remain unpowered and dormant except for a low power "idling function" until activation by the user pushing and holding the button. Release of the button returns the system to a lower power state. The battery drain is thus minimized, allowing for a much smaller and longer lasting battery.

Alternately, waking up the board could initiate a timer, holding the water solenoid open for a predetermined dispense time even though the dispensing button is released by the operator in the meantime.

Accordingly, the invention provides a unique system wherein the circuitry remains in a low power state until the chemical source is selected and the dispensing or activation button is pushed to cause the circuit board to be shifted into a higher power states so the RFID based chemical confirmation control can facilitate operation of the latching solenoid (and water valve) where there is a chemical match of source and receiver, or block such operations when there is a mismatch.

Thus, an input which identifies the chemical selected is provided, while at the same time an RFID-based chemical dispensing control is battery powered with a low electrical draw, allowing use of smaller batteries than in the past. Manual selection of a source chemical station allows the dispenser to automatically confirm, by reading the RFID tag on the receiving container, that the chemical dilution is one which is proper for that container. This provides substantial flexibility in the dispenser for placement of source containers but without loss of dispensing integrity. And the entire system insures that on loss of power, an incorrect chemical dilution cannot be dispensed to a non-approved container.

Alternately, it will be appreciated that a dispenser can be provided with a remote fill nozzle having an RFID reader for reading the RFID tag on a mop bucket to insure dispensing from the nozzle into the mop bucket of a proper chemical dilution, as if the mop bucket were a receiving container of the type noted above and placed at the receiving station.

Finally, and in addition to the chemical information contained in the RFID tags, additional data representing other useful information can be carried in the tags and read. Such data includes but is not limited to the chemical type or name, the manufacturer, the concentration or dilution ration, material information, number of doses, a manufacture and expiration date and other relevant information for sensing or control purposes.

These and other objects and advantages will become even more readily apparent from the following written description and from the drawings in which:

FIG. 5 illustrates the "learn" operation of the invention; while FIG. 6 illustrates the dispensing operation of the invention.

Figure 1:
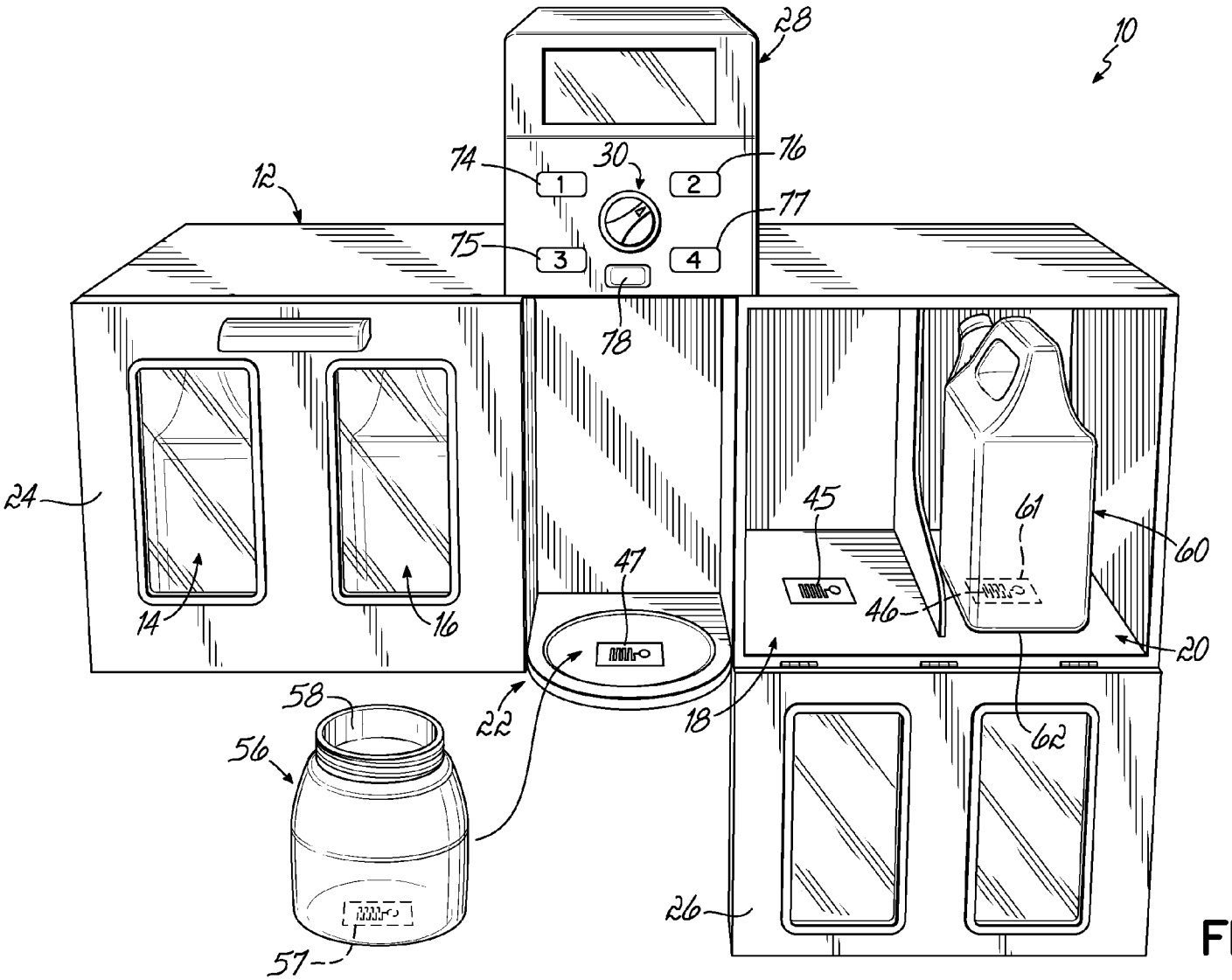
FIG. 1 is a perspective view of a dispenser, a source and a receiving container, according to the invention.

Turning now to FIGS. 1 and then 2, a dispenser 10 according to the invention is illustrated for clarity of description. Such a dispenser 10 includes a cabinet 12 defining a plurality of chemical source or docking stations 14, 16, 18 and 20 although any reasonable number, preferably two or more, could be used. A discharge or receiving docking station 22 is oriented at any suitable position such as shown. Cabinet 12 includes doors 24, 26 for closing stations 14, 16 and 18, 20 respectively. Windows or openings may be located in doors 24, 26 for visual purposes into stations 14, 16, 18 and 20.

Dispenser 10 includes a housing 28 covering a selector valve 30 and associated eductor (not shown), and of any suitable configuration. An on/off solenoid valve 32 of the latching type is disposed between a water source 34 and selector valve 30. Valve 32 is operated by a latching solenoid 36 driven by a solenoid driver 38. When driver 38 actuates solenoid 36, the solenoid opens valve 32 to pass water to selector valve 30 for dilution and dispensing of chemical. When the driver 38 is deenergized, solenoid operates to shut or close valve 32, ceasing dilution and dispensing of diluted chemical.

A backflow preventor (not shown) is preferably disposed in the water source line between source 34 and selector 30. Such apparatus may be of any suitable construction like that disclosed in one or more of the following U.S. Pat. No. 6,634,376; 5,159,958; 5,522,419 or 5,862,829, all of which are herein expressly incorporated.

Figure 2:
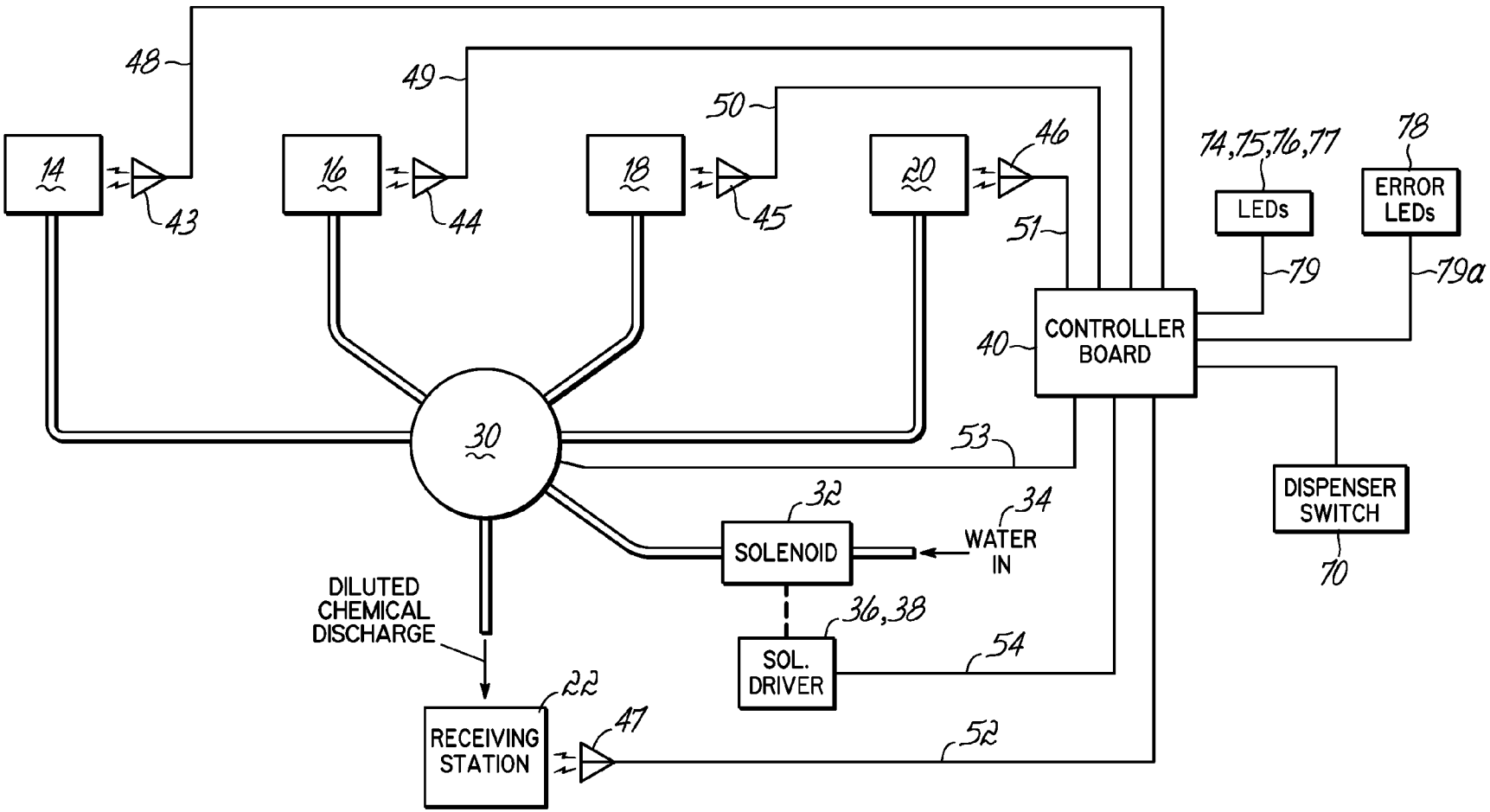
FIG. 2 is a diagrammatic illustration of features of the dispenser of FIG. 1.

FIG. 2 illustrates both concentrated chemical, water and diluted discharge paths as double lines. In addition, FIG. 2 illustrates in continuous lines the operational interconnection of an electronic control board 40 with RFID readers or antennas 43, 44, 45, 46, 47, with selector valve 30 and with solenoid valve 32.

Antennae 43-46 are operably connected to board 42 by board input wires or cables 48, 49, 50, 51, respectively. Antenna 47 is operably connected to board 40 by board input wire or cable 52. Selector valve 30 is operably connected to board 40 by board input wires or cables illustrated at 53. Solenoid valve 32 is connected to board 40 by board output wire or cable 54.

It will be appreciated that the selector valve 30 is provided with magnets or other switches or contacts which signal board 40 which chemical is selected as a function of the position of the selector valve. It will be understood that the selector valve is otherwise any suitable selector valve such as that illustrated in U.S. Pat. Nos. 6,299,035; 6,655,401; 5,377,717 and 5,653,261, as an example only, which, patents are herewith incorporated herein by reference.

Preferably, selector valve 30 has a plurality of chemical inputs or connectors, each operably connected to a chemical source station 14, 16 18 or 20. Positioning valve 30 in a selected position thus operably connects the chemical source station for that position to the selector valve 30 and communicates that source with an associated eductor for drawing chemical from that source into a diluent, such as water, for dilution and discharge into a receiving container such as container 56 having an RFID tag 57 thereon. Container 56 has a receiving mouth 58 for receiving diluted chemical discharging from dispenser 10 when container 56 is disposed at station 22.

With respect to the structure of dispenser 10, it will be appreciated that stations 14, 16, 18 and 20 are sized approximately to receive chemical source containers such as chemical container 60 (FIG. 1) shown at station 20. Container 60 has a RFID lag 61, with information specific to the chemical concentrated in container 60, mounted thereon in an approximate position such as on the container bottom 62.

Figure 3:
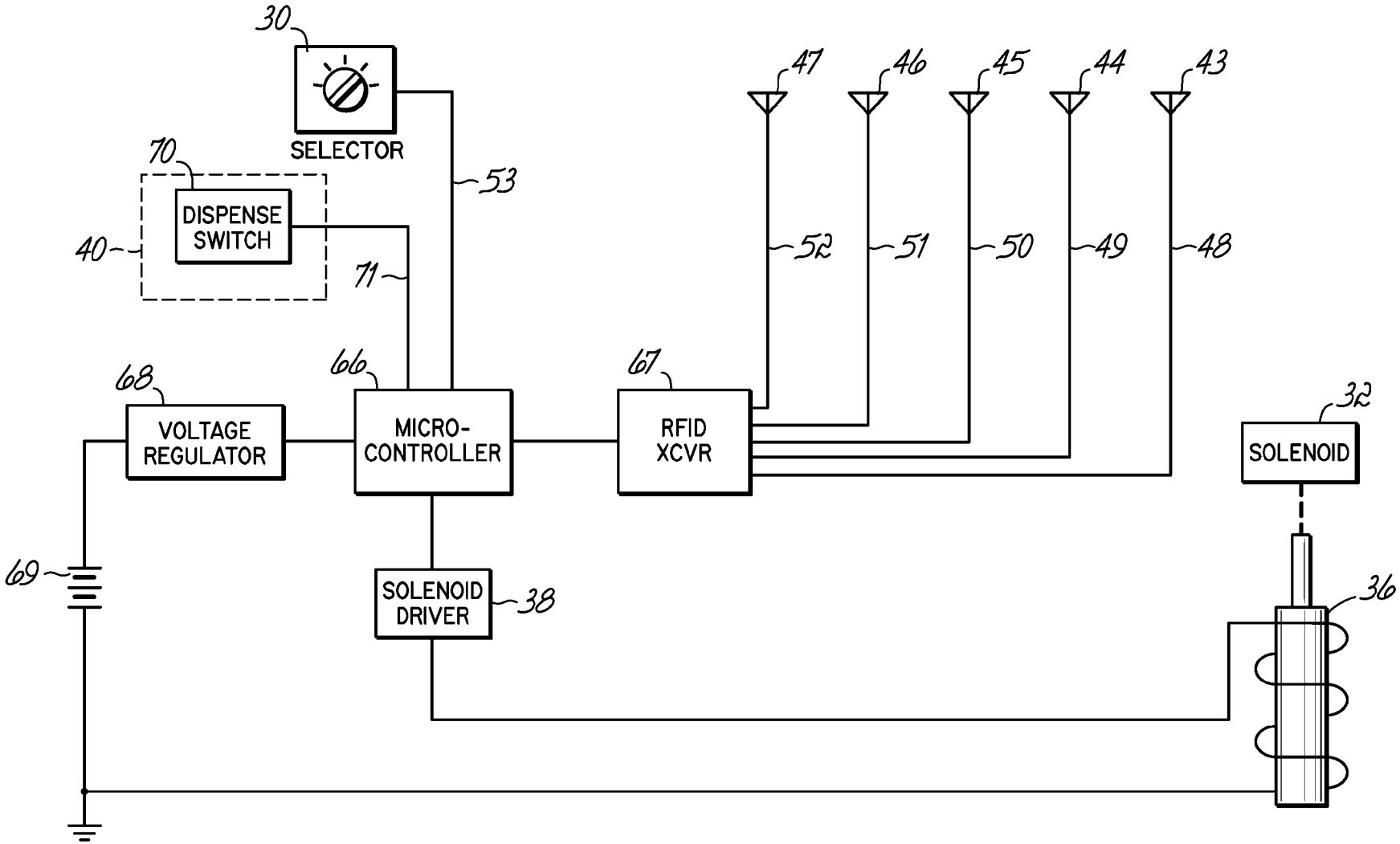
FIG. 3 is a diagrammatic circuit diagram of features of the electronic control of the dispenser of FIGS. 1 and 2.
Figure 5:
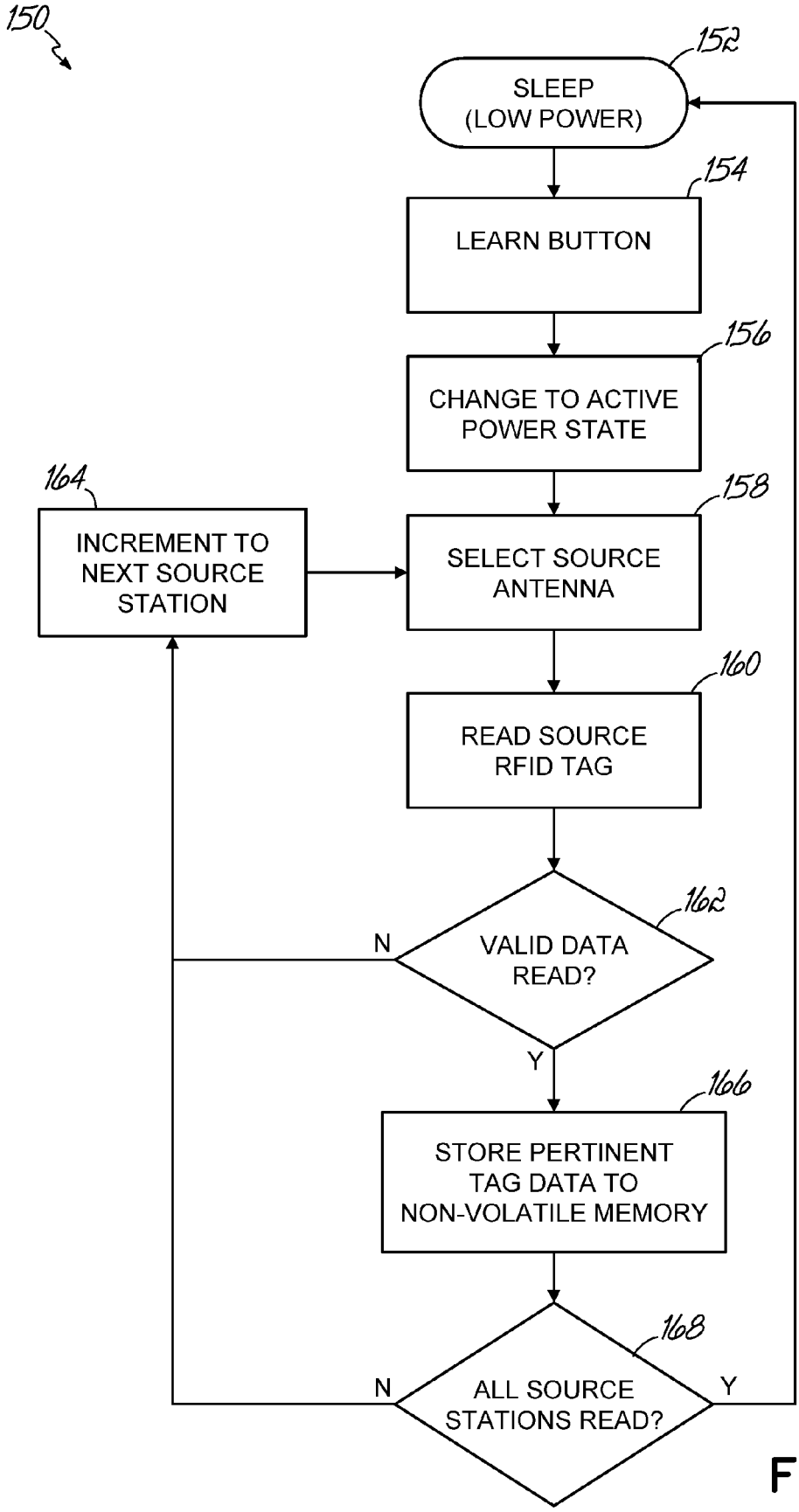
FIG. 5 and FIG. 6 are respective charts illustrating the controller logic for various features of the invention.
Figure 6:
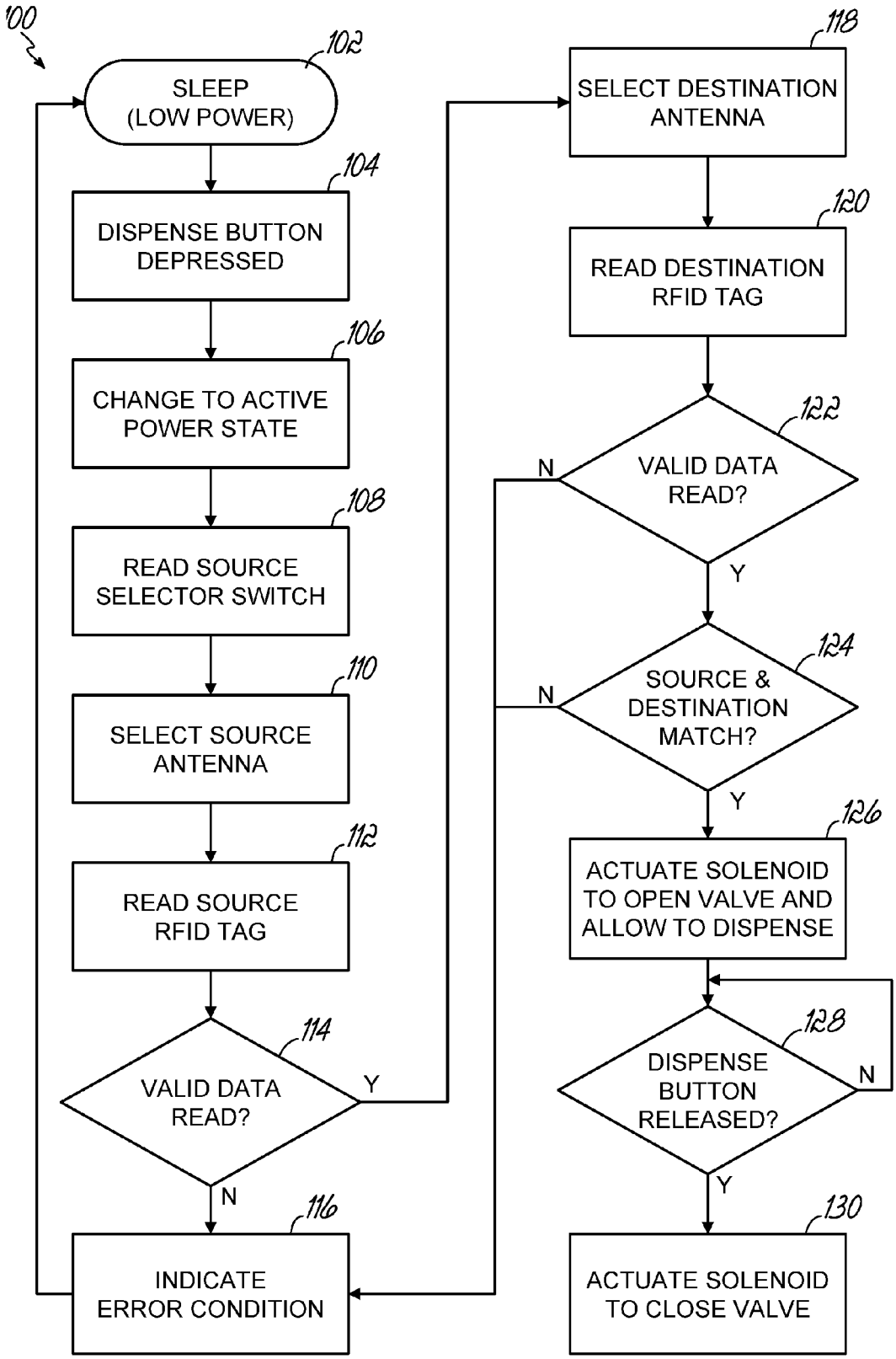

Turning momentarily to FIG. 3, there is graphically illustrated a circuitry diagram according to the invention such as that in FIG. 2 but showing more of the circuit in detail. Parts of the circuit or control illustrated have already been described. The circuit illustrated in FIG. 3 includes a controller 66 of any suitable type for carrying out the interconnection, datastorage and function of the invention as described herein. The controller logic is illustrated in FIGS. 5 and 6 described below. The circuit also includes an RFID transceiver 67 for receiving signals from antennae 43-47 and delivering them to the controller 66 for processing. A voltage regulator 68 is connected between a battery 69 and controller 66.

Further operably connected to the board 40 is a dispenser switch 70 connected to controller 66 by an electric cable or wire 71. Presuming appropriate dispensing parameters exist (i.e. an appropriate chemical container in the same position selected by switch selector valve 30 and an appropriate receiving container 56 at discharge station 22), activation of switch 70 wakes up the controller 66 from a low power to a higher power state, energizes driver 38 and causes solenoid 36 to open the water inlet valve 32 to pass water diluent through a selector valve 30 to an eductor for drawing chemical for the selected source container and dispensing diluted chemical in receiving container 56. Preferably when pressing switch 70, its movement on or toward board 40 and consequent movement of a magnet associated with the switch, is operable to cause sensing of that magnet's movement by a Hall effect sensor (of any suitable type), which is connected to cause full high power state operation of the board 40 or, in other words, wake it up to full power. When the switch 70 is released, its magnet is moved away from the Hall effect sensor and the valve solenoid is unlatched, closing water valve 32.

In this regard, it will be appreciated that when no dispensing is occurring and the system is inactive, the controller 66 is in a lower power state and draws only a very small amount of current from battery 69. Such minimal current is thus used when the system or controller is "idling" or, in other words, is not energized to compare signals from antennae 43-47, to analyze, to compare to stored data, to close a circuit between dispenser switch 70 and driver 38 or open same in the event of an error. In its "idling", low draw state, the only current required is to power one or more LEDs for status indicating purposes, such as for a low battery, etc.

In operation, preferably data from one or more useful and appropriate decimals are programmed or stored into the controller 66. When a source container such as that at 60 is placed in a source station 14, 16, 18 or 20, its RFID tag 61 is in a position to be read by an antenna, such as by antenna 46. But the tag is not read at this point. An RFID tag 57 on a container such as 56 is disposed with the container in discharge station 22 in position for sensing by antenna 47. But the tag 57 is not read at this time.

An operator moves the selector switch 30 to a position corresponding to source position 20, for example, for the chemical he desires. When the dispensing switch 70 is then pushed, this movement is sensed by the board 40, thus waking up the board to full power. The controller 66 compares the chemical data from the RFID tag 61 on the chemical container to the stored data of approved chemicals. As well, controller 66 compares data from RFID tag 57 on container 56 to confirm the container's compatibility for receiving the diluted chemical selected.

Upon confirming the match up of receiving container 56 and source container 60 to be discharged, the controller 66 energizes driver 38 to latch open solenoid 36 and water inlet valve 32. When container 56 is filled, the operator releases switch 70. Power to board 40 is interrupted when this movement is sensed by the Hall effect sensor on board 40 and controller 66 causes driver 38 to relatch or unlatch or disconnect solenoid 36 from any power, thus closing valve 32 and stopping water flow through selector 30 to the eductor. Chemical suction and diluted chemical discharge is discontinued.

Thereafter, board 40 (i.e. controller 66) is powered down or goes into sleep or low power mode, pulling only an insignificant draw from battery 69 as noted above, preparatory to the next cycle.

It will be appreciated that if power fails, such as if battery 69 finally discharges, power is lost to driver 38 and solenoid 36, causing the valve 32 to shut down and thereby preventing continued discharge.

A chemical source container can thus be placed in any source station 14, 16, 18 or 20 sensed, and confirmed by comparison with the stored data. Only upon an approved match with the data for the RFID tag 57 on container 46, however (once switch 70 is depressed), will dispensing proceed.

In another aspect of the invention, the controller 66 is capable of a "learn" mode. More particularly, one or more chemical source containers are placed in respective source station(s) 14, 16, 18 and 20. A "learn" cycle is initiated by activation of a "learn" button. Activation of the "learn" cycle checks the antenna signal from the antenna at each station, reading the RFID tag for the source container at the station. The information signal is compared to a pre-programmed library of chemicals suitable for dispensing from the respective stations. Upon a match, a respective LED 74-77, preferably positioned proximate that station's indicator at the selector switch 30 is lit, indicating an appropriate chemical source is located at that station (LEDs 74-77 are connected to controller 66 via wires or cables 79). Then, dispensing will commence as noted above if the RFID tag information on the receiving container 56 is confirmed a match to the chemical at the source station selected. If a match is not confirmed (or when a chemical source is not approved for a particular station), an error LED 78 is energized and no dispensing can be commenced since no power is applied to solenoid driver 38. Error LED 78 is connected to controller 66 via wire or cable 79*a*.

In another aspect of the invention, it will be appreciated that additional information can be stored in the RFID tags on the chemical source containers. Such information can be useful for additional processing and control functions. For example, these include but are not limited to:

1. chemical type and/or name.

2. chemical manufacturer—this could allow the dispenser device to prevent dispensing chemical made by certain manufacturers, or to only allow dispensing of chemical made by a specific manufacturer.

3. concentration or dilution ratio—source chemicals are typically shipped in concentrate form and then diluted by venturi eductor or some other dilution method. In order to maintain safe and effective use of the chemical, the dilution system must be set to a dilution ratio matching the source chemical concentration. Dilution ratio data stored in a source container RFID tag could be read by the dispenser and used to verify that the concentrate matches the dilution ratio of the dispenser, and prevent dispensing in case of a mismatch. Alternatively, a variable-dilution dispensing system could use the tag data to set the correct dilution ratio for the chemical selected to be dispensed. This could prevent incorrect chemical dilution due to concentrate/dilution ratio mismatches.

4. hazardous material (HAZMAT) information.

5. number of doses in container—can be either the total number of doses in the source concentrate container when full, or can be decremented by the reader after each dispense operation to indicate the number of doses remaining in the source concentrate container. This information can be used by the dispenser to warn the user or maintenance personnel when a chemical is running low or is "out".

6. manufactured date or expiration date—can be used by the dispenser to warn or prevent dispensing of chemicals that have a limited "shelf life" and will lose effectiveness or become dangerous after this shelf life has expired. This would require the dispenser to have knowledge of the current time and date (real time clock).

Figure 4:
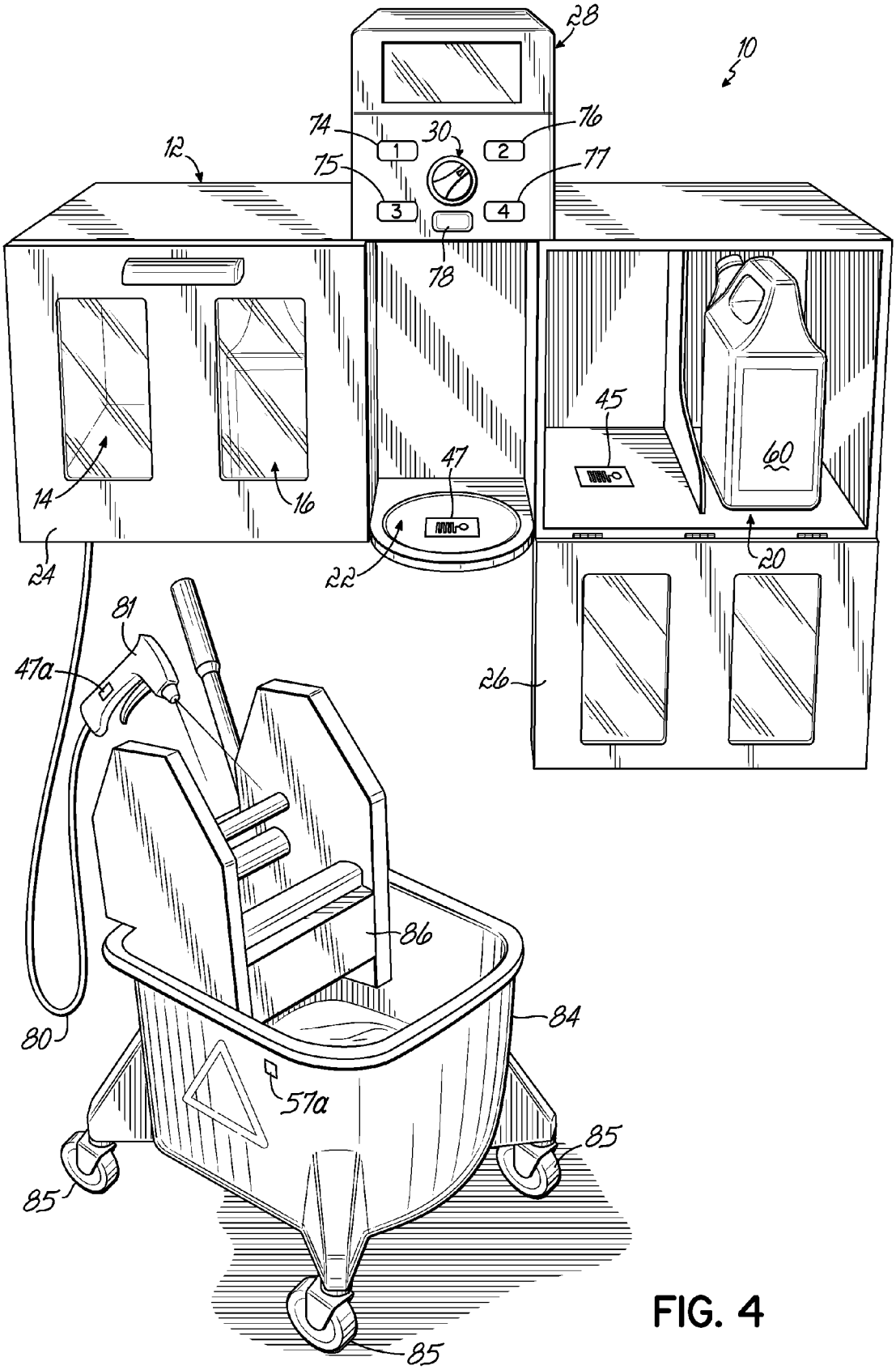
FIG. 4 is a perspective view similar to FIG. 1 but showing an alternative embodiment of the invention.

In an alternative embodiment of the invention shown in FIG. 4, a discharge hose 80 from the eductor is connected to a nozzle 81 carrying an antenna 47A corresponding in function to that of antenna 47 where a receiving container 56 is used. Instead, antenna 47*a* on nozzle 81 is used to sense an RFID tag 57*a* on a mobile mop bucket 84. Tag 67*a* functions similarly to that of tag 57 on container 56. Mop bucket 84 is mounted on wheels 85 and includes an upper rinse chamber 86.

Accordingly, dispenser 10, when provided with option hose 80, nozzle 81 and antenna 57*a* can be used to fill mobile mop bucket 84 with appropriate diluted chemical concentrate while all the beneficial functions and features of dispenser 10 are retained.

It will be appreciated that operation of nozzle 81 can interrupt any discharge at discharge station 22 when filling the mop bucket 84. For example, extension of hose 80 may function in such a way to activate a divert valve to hose 80, nozzle 81, or hose 80 may be fitted with a quick disconnect, conveying normal discharge to station 22 or when alternately connected to divert discharge to nozzle 81.

In such an embodiment, the antenna line and the discharge hose can be co-extended, or interconnected.

Further describing an embodiment of the invention, the logic used by the controller 66 to operate the dispenser 10 is illustrated in the flowchart 100 in FIG. 6. The dispensing system waits in a low power state (block 102) until a dispense button is pressed (block 104). After the button has been depressed, the controller and dispensing system changes from the low power state to a higher energy level or active power state (block 106). Once powered up, the controller reads the source selector switch (block 108) and selects a source antenna (block 110) based on the selector switch. The controller then reads an RFID tag associated with the source (block 112). A check is made to determine if valid data was read from the source RFID tag (block 114). If there was no valid data read ("No" branch of decision, block 114), then an error condition is indicated (block 116) and the system returns to a low power state (block 102) and waits for the next request.

If valid data was read from the source RFID tag ("Yes" branch of decision block 114), then a destination antenna is selected (block 118) that corresponds to the source. The controller then reads an RFID tag associated with the destination (block 120). Again a check is performed to determine if valid data was read from the destination RFID tag (block 122). If there was no valid data read ("No" branch of decision block 122), then an error condition is indicated (block 116) and the system returns to a low power state (block 102) and waits for the next request. If, however, valid data was read from the destination RFID tag ("Yes" branch of decision block 122), the data from the source and destination RFID tags is compared (block 124). If there is a mismatch between the source and destination data ("No" branch of decision block 124), then an error condition is indicated (block 116) and the system returns to a low power state (block 102) and waits for the next request. However, if the source and destination data match ("Yes" branch of decision block 124), a solenoid is actuated, opening a valve to allow the contents of the source to dispense to the destination location (block 126). Dispensing continues as long as the dispense button remains depressed (block 128). When the dispense button is released ("Yes" branch of decision block 128), the solenoid is again actuated closing the dispensing valve (block 130). At the completion of the dispensing, the system returns to a low power state (block 102) and waits for the next request.

In some embodiments the controller may additionally have a learn mode. One embodiment of the learn mode may be seen in the flowchart 150 in FIG. 5. The dispensing system waits in a low power state (block 152) until the learn button is depressed (block 154). After the button has been depressed, the controller and dispensing system changes from the low power state to a higher energy level or active power state (block 156). In the learning mode, the dispensing system learns the contents of each of the source stations. A first station is selected and the controller selects the source antenna (block 158) for that station. The controller then reads data from the source RFID tag (block 160). If no valid data was read ("No" branch of decision block 162), the controller then proceeds to increment to the next source station (block 164) and starts the process again by selected the source antenna (block 158) associated with the new station. Otherwise, if valid data was read ("Yes" branch of decision block 162), the data read from the source RFID tag may be stored in a non-volatile memory (block 166). The non-volatile memory may be a memory within the controller itself in some embodiments, or the non-volatile memory may be in the form of destination RFID tags for other embodiments. For the latter embodiments, pertinent data read from the source RFID tags may be stored on the destination RFID tags to be read later during the operation of the dispensing system as illustrated in flowchart 100 in FIG. 6. After the storage of the data, a check is made to see if there are additional source stations (block 168). If an additional source station is present ("No" branch of decision block 168), the source station is incremented to the next source station (block 164) and the learning process continues at block 158. If there are not additional source stations ("Yes" branch of decision block 168), then the dispensing system returns to a low power state (block 152) and waits for the next request.

Accordingly, the invention provides numerous advantages while securing the integrity of the dispenser for accurate chemical dispensing. Small, inexpensive batteries can be used to produce efficient, long duration operational cycles with enhanced time between battery changes. The system is flexible in accommodating a variety of chemical sources in a variety of source stations.

These and other modifications, methods and apparatus will become readily apparent to those of ordinary skill in the art without departing from the scope of the invention and applicant intends to be bound only by the claims appended hereto.

What is claimed is:

1. A dispenser for dispensing diluted chemicals into a receiving container, said dispenser comprising:

a plurality of chemical source stations, at least one of said plurality of stations adapted to receive a container defining a source of at least one concentrated chemical;

a selector switch for selecting at least one of said stations for dispensing of a concentrated chemical therefrom;

a programmable controller programmable with a readable library of acceptable respective chemical data of a plurality of chemicals for respective chemical source stations;

an eductor for drawing concentrated chemical from a selected station into a diluent and discharging a mix of diluent and chemical;

a mix receiving station;

a receiving container operably positionable in said receiving station for receiving said mix;

a diluent valve having a closed position and an open position for passing the diluent to said eductor when in an open position;

a solenoid for operating said diluent valve; and a circuit comprising a battery and a solenoid for operating said diluent valve to an open position in response to solenoid activation and a signal confirming the chemical in the selected source station is one of the chemicals corresponding to data for one of the chemicals in said pre-programmed library of chemicals for the one position of said selector switch.

2. A dispenser as in claim 1 further including an antenna disposed proximate each source station for receiving data from an RFID tag mounted on a chemical source container and an antenna disposed proximate said mix receiving station for receiving data from an RFID tag mounted on a mix receiving container disposed at said receiving station.

3. A dispenser as in claim 2 comprising a dispenser switch operable to initiate dispensing of a mix in the presence of a receiver container matched to a chemical source operably disposed at a selected chemical source station.

4. A dispenser as in claim 3 further including a controller having a low power operational state and a full power operational state, both states powered by said battery, said controller being in said low power state until energized into said high power state by activation of said dispenser switch.

5. A dispenser as in claim 4 wherein said controller includes a learn mode and a data storage for learning and storing chemical-related information read from an RFID tag on a chemical source container in said library for a selected position of said selector switch.

6. A dispenser as in claim 5 wherein said controller includes a comparison mode for comparing information received from an RFID tag on a receiving container to information received from an RFID tag on a chemical source container at a selected source station.

7. A dispenser as in claim 6 further including a visual error display actuated by said controller when a chemical source at a source station does not match information stored in said controller for that station, or when a chemical source at a selected station does not match information received by said controller from an RFID tag on a mixture receiving container.

8. A dispenser as in claim 4 further including a reader operably coupled to said controller for receiving signals from said antenna and communicating data to said controller.

9. A dispenser as in claim 1 further including a solenoid driver for latching said solenoid between diluent valve open and closed positions.

10. A dispenser as in claim 1 wherein said selector valve operably communicates a chemical source at a selected source station with an eductor for drawing chemical from said source of said selected station into said eductor for dilution and discharge once said diluent valve is opened.

11. A dispenser as in claim 1 wherein said receiving container is a mop bucket.

12. A dispenser as in claim 11 further including a hose connected to said eductor for receiving said mix, and a nozzle for dispensing said mix from said hose to said mop bucket.

13. A method of dispensing a selected chemical from a chemical source container at a chemical source station in a dispenser including a plurality of chemical source containers at respective chemical source stations, each container at a source station providing machine readable data representing information specific to the chemical therein, said dispenser having a multiple position selection switch with respective positions operably connected to select a particular chemical source station for dispensing of a chemical in a container therein, said method comprising:

programming a controller with a data library comprising data for a plurality of selectable chemicals to be dispensed from respective ones of a plurality of chemical source stations;

operating said selector switch to one position associated with a chemical source station; comparing the data from the chemical source container at said station selected to said data library to confirm the data from the chemical source selected matches one of the chemical data in the library for said source station; and dispensing the chemical to a receiving container providing machine readable data corresponding to the information from the selected chemical source container.

14. A method as in claim 13 wherein said dispenser includes a controller having a low power and a high power state, said method comprising the step of:

transitioning the controller to said high power state upon activation of a dispensing switch and initiating said dispensing.

15. A method as in claim 14 including ceasing said dispensing by deactivating said switch and returning said controller to lower power state.

16. A method as in claim 14 including operating a diluent valve to an open position when said controller reaches said high power state by energizing a solenoid drive and actuating a solenoid to open said diluent valve.

17. A method as in claim 13 including receiving information representative of a concentrated chemical source at a source station, comparing said information to a data library of acceptable chemicals and indicating an error if said information is incompatible with said data library.

18. A method as in claim 17 including the step of comparing chemical representative information from a chemical source to information collected from a receiving container and preventing said dispensing if said information is incompatible.

19. A method as in claim 14 including the step of electrically powering said controller with a battery operably connected thereto.

20. A dispenser for dispensing selected chemicals from a selected one of a plurality of chemical sources and including:

a plurality of chemical source stations;

a chemical source container in at least one of said stations and providing a data signal representative of a chemical in said container at said station;

a selector switch having a plurality of positions respectively associated with a respective station for selecting a chemical source for dispensing from said respective station;

a data library programmable with data for chemicals acceptably associated with each station;

a diluents valve operable to draw chemical from a selected chemical source at said respective station said selector switch interconnecting data from said library for a station to a data signal from a chemical source container at said station for comparison of said data and said data signal when data from said container at said station matches data of one of the chemicals in said data library for the selected chemical source station and dispensing said chemical.

21. A chemical as in claim 20 further including a receiver container providing a data signal representative of a chemical to be received therein;

said diluents valve being operative to dispense chemical into said receiver container when the data signal therefrom matches the chemical data from the chemical source container.

* * * * *